US011179765B2

(12) United States Patent
Enoki et al.

(10) Patent No.: US 11,179,765 B2
(45) Date of Patent: Nov. 23, 2021

(54) FORMING APPARATUS AND FORMING METHOD FOR NECK PORTION OF BOTTLE-SHAPED CAN

(71) Applicant: DAIWA CAN COMPANY, Chiyoda-ku (JP)

(72) Inventors: Yasushi Enoki, Sagamihara (JP); Osamu Yoshida, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 348 days.

(21) Appl. No.: 16/267,418

(22) Filed: Feb. 5, 2019

(65) Prior Publication Data

US 2019/0248532 A1 Aug. 15, 2019

(30) Foreign Application Priority Data

Feb. 9, 2018 (JP) ..... JP2018-021948

(51) Int. Cl.
*B21D 51/26* (2006.01)
*B21D 51/38* (2006.01)

(52) U.S. Cl.
CPC ..... *B21D 51/2615* (2013.01); *B21D 51/38* (2013.01)

(58) Field of Classification Search
CPC . B21D 51/2615; B21D 51/38; B21D 51/2638
USPC ..... 413/22, 23; 72/379.4
See application file for complete search history.

(56) References Cited

U.S. PATENT DOCUMENTS 1,705,843 A * 3/1929 George ..... B21D 51/386 413/38
3,874,209 A * 4/1975 Maiorino ..... B21D 51/263 72/91
4,272,977 A * 6/1981 Gombas ..... B21D 51/2615 72/121
4,308,737 A * 1/1982 Kannegiesser .... B21D 51/2638 72/105
4,838,064 A * 6/1989 Pass ..... B21D 51/2615 72/105
2005/0218140 A1* 10/2005 Enoki ..... B65D 51/1688 220/62.22

FOREIGN PATENT DOCUMENTS

JP 4723762 7/2011

* cited by examiner

*Primary Examiner* — Gregory D Swiatocha
(74) *Attorney, Agent, or Firm* — Oblon, McClelland, Maier & Neustadt, L.L.P.

(57) ABSTRACT

An apparatus and a method for accurately processing a neck portion of a bottle-shaped can without changing a posture of the can. An inner tool is inserted into the neck portion from the bottom of a can body to form a stepped portion, and comprises a first forming section having a diameter smaller than an inner diameter of a neck portion. An outer tool comprises a second forming section that is opposed to the inner tool. The stepped portion is formed on the neck portion by sandwiching the neck portion by the first forming section and the second forming section. The inner tool further comprises a holding member that is situated coaxially with the can body to be contacted to an inner surface of the can body. The holding member is attached to the inner tool while being allowed to move in a radial direction together with the can body.

8 Claims, 5 Drawing Sheets

FORMING APPARATUS AND FORMING METHOD FOR NECK PORTION OF BOTTLE-SHAPED CAN

The present invention claims the benefit of Japanese Patent Application No. 2018-021948 filed on Feb. 9, 2018 with the Japanese Patent Office, the disclosure of which is incorporated herein by reference in its entirety.

BACKGROUND

Field of the Invention

The present invention relates to an art of an apparatus and a method for forming a thread and a bead on a neck portion as a container mouth of a metallic bottle-shaped can.

Discussion of the Related Art

The bottle-shaped can of this kind is shaped into a bottle-shape by drawing and ironing a metallic material such as an aluminum material. The bottle-shaped can thus formed comprises a trunk portion in which a diameter thereof is relatively large, a shoulder portion in which the diameter is reduced gradually, and a neck portion in which the diameter is further reduced. An opening of the neck portion is closed by a cap or a closure.

For example, a resealable cap is applied to the neck portion of the bottle-shaped can. In this case, a thread is formed on a skirt portion of the cap and the neck portion. In addition, a pilfer-proof ring is formed on a lower end of the skirt of the cap for the purpose of tamper evidence. Once the cap is twisted to open the bottle-shaped can, the pilfer-proof band is detached from the skirt of the cap, and held in an annular groove formed on a neck portion below the skirt and an emboss bead. The opening of the neck portion is curled to confine a sharp edge of the metallic material in a curled portion, and to enhance a sealability of the bottle-shaped can.

For example, Japanese Patent No. 4723762 describes a method and an apparatus for forming the thread and the emboss bead on the neck portion of the can. According to the teachings of Japanese Patent No. 4723762, the thread and the emboss bead are formed on the neck portion by inserting an inner tool into the neck portion, and revolving the inner tool along a fixed outer tool while rotating the inner tool. According to the teachings of Japanese Patent No. 4723762, therefore, the thread and the emboss bead may be formed on the neck portion at a high speed.

According to the conventional method, the inner tool is inserted into a can body from a bottom opening of the can body before closing the bottom opening by a bottom lid, and withdrawn from the can body after processing the neck portion. In order to allow the inner tool to reciprocate within the can body, a certain clearance is required between the inner tool and an inner surface of the can body. Specifically, the thread and the emboss bead are formed by deforming the neck portion partially in a radial direction. Therefore, in order to withdrawn the inner tool smoothly from the can body after forming the thread and the emboss bead on the neck portion, a sufficient clearance is required between the inner tool and the inner surface of the neck portion which is partially depressed radially inwardly.

In order to form the thread and the emboss bead, the can body fitted loosely onto the inner tool is conveyed to the outer tool. In this situation, the can body is not fixed to the inner tool, and hence the can body may be inclined or tilted inevitably on the inner tool by an external force such as vibrations. Consequently, the can body may be brought into contact to a guide member, and the neck portion may be sandwiched between the inner toll and the outer tool while being inclined.

In addition, when the neck portion is sandwiched by the inner too and the outer tool, a load to from the thread and the emboss bead is applied in the radial direction to the neck portion situated away from a gravity center of the can body. As described, the predetermined clearance is maintained between the inner tool and the inner surface of the neck portion. In this situation, therefore, the can body is allowed not only to move in the radial direction but also to incline with respect to a center axis of the can body.

Thus, the thread and the emboss bead are formed on a limited site of the can body located away from the gravity center. Therefore, when the forming load is concentrated on such limited site to form the thread and the emboss bead, the can body may be inclined with respect to the inner tool and the outer tool. Given that the forming load is applied to a plurality of sites of the can body away from one another in the axial direction, the above-explained condition to incline the can body with respect to the inner tool and the outer tool is realized temporarily if the forming load is applied to those sites at different timings.

If the neck portion is processed while being inclined, the neck portion may be deformed into an oval shape, and a thread may be formed on a site different from a desired site. In those cases, the cap may not be mounted correctly on the neck portion by a roll-on capping. In addition, if the emboss bead is formed at an undesirable site, a lower end portion of the skirt of the cap may not be swaged sufficiently onto the emboss bead. In this case, when the cap is twisted to be dismounted from the neck portion, the pilfer-proof band would not be detached from the skirt portion and dismounted from the neck portion together with the cap. By contrast, if the lower end portion of the skirt of the cap is swaged excessively onto the emboss bead, the skirt portion of the cap may be wrinkled. In this case, the wrinkled pilfer-proof band may not stick tightly to the emboss bead. Therefore, when the cap is twisted to be dismounted from the neck portion, the pilfer-proof band would also not be detached from the skirt portion and dismounted from the neck portion together with the cap.

SUMMARY OF THE INVENTION

The present disclosure has been conceived noting the foregoing technical problems, and it is therefore an object of the present disclosure to provide an apparatus and a method for accurately processing a neck portion of a bottle-shaped can without changing a posture of the can.

According to one aspect of the present disclosure, there is provided a forming apparatus for forming a surface profile on a neck portion of a can body of a bottle-shaped can. Specifically, the forming apparatus is adapted to process a can body comprising: a trunk portion in which a bottom is opened; a shoulder portion which is formed continuously from the trunk portion on an opposite side to the opening, and in which a diameter is reduced gradually; and a neck portion which is formed continuously from the shoulder portion on an opposite side to the trunk portion, in which the diameter is further reduced, and which is opened around a center axis of the can body. The forming apparatus comprises: an inner tool which is allowed to rotate and revolve, and to which the can body is fitted loosely thereon; and an outer tool that is situated along a revolution orbit of the inner tool. The forming apparatus is configured to form the surface profile on the neck portion in a circumferential direction by sandwiching the neck portion between the outer tool and the inner tool revolving along the outer tool. The inner tool comprises a first forming section having a diameter smaller than an inner diameter of the neck portion, that is inserted into the neck portion from the bottom of the can body to form the surface profile. The outer tool comprises a second forming section that is opposed to the inner tool to form the surface profile on the neck portion by sandwiching the neck portion by the first forming section and the second forming section. The inner tool further comprises a holding member that is situated coaxially with the can body to be contacted to an inner surface of the can body. The holding member is attached to the inner tool while being allowed to move in a radial direction together with the can body.

In a non-limiting embodiment, the can body may comprises a boundary portion between the shoulder portion and the neck portion. The boundary portion may include a depressed portion in which a cross-section of the neck portion in an axial direction protrudes inwardly. The holding member may comprise a contact surface that is brought into contact to the boundary portion from inside of the can body.

In a non-limiting embodiment, the holding member may be shaped into a ring shape. The inner tool may further comprise a holding section in which the holding member is held while being allowed to move in the radial direction. The holding section may comprise guide surfaces formed perpendicular to a center axis of the inner tool respectively and parallel to each other to sandwich the holding member from both sides in an axial direction of the inner tool.

In a non-limiting embodiment, the forming apparatus may further comprise a chuck member that pushes the can body in the axial direction of the can body. The chuck member may comprise a contact surface that is formed perpendicular to the center axis of the can body to be contacted to a tip of the neck portion.

According to another aspect of the present disclosure, there is provided a forming method for forming a surface profile on a neck portion of a can body of a bottle-shaped can in a circumferential direction, by fitting the can body loosely onto an inner tool, and revolving the inner tool along an outer tool thereby sandwiching the neck portion between the inner tool and the outer tool. According to the forming method, the can body is held by a movable member attached to the inner tool in such a manner that a center axis of the can body is aligned parallel to a center axis of the inner tool, when the inner tool reaches a position at which the outer tool is situated and the neck portion of the can body is pushed onto the outer tool to be displaced relative to the inner tool.

The can body may be held by bringing the movable member into contact to an inner surface of a portion of the can body where a shoulder portion and a neck portion are formed continuously.

According to the forming method, a tip of the neck portion may be pushed entirely or at a plurality of portions in a direction parallel to the center axis of the can body, when the neck portion is sandwiched between the inner tool and the outer tool.

Thus, according to the exemplary embodiment of the present disclosure, the surface profile as a stepped portion is formed on the neck portion of the can body in the circumferential direction, by sandwiching the neck portion of the can body fitted onto the inner tool by the outer tool and the inner tool. Before the revolving inner tool on which the can body is fitted reaches the outer tool, the can body may be displaced radially outwardly on the inner tool by a centrifugal force or an inertial force resulting from vibration. By contrast, when the inner tool reaches the position at which the outer tool is situated and the neck portion of the can body is brought into contact to the outer tool, the can body may be displace radially inwardly by a force applied from radially outer side. In order to allow the can body only in the radial direction without inclining and without moving in the axial direction, according to the exemplary embodiment, the can body is held by the holding member. According to the exemplary embodiment, therefore, the can body fitted onto the inner tool is allowed to displace only in the radial direction perpendicular to the center axis of the inner tool, when subjected to the external force such as the centrifugal force. For this reason, the can body will not be inclined with respect to the inner tool even when the neck portion is sandwiched between the inner tool and the outer tool, and hence the surface profile such as the stepped portion can be formed accurately on the neck portion.

As described, the holding member comprises the contact surface having a certain contact area that is brought into contact to the inner surface of the boundary portion between the shoulder portion and the neck portion of the can body. According to the exemplary embodiment, therefore, the can body may be supported by the contact surface of the holding member that can receive a radial load and an axial load applied to the can body. In addition, the can body is allowed to move only in the radial direction on the inner tool. For this reason, the can body can be supported certainly without inclining on the inner tool so that the surface profile is formed accurately on the neck portion.

In addition, according to the exemplary embodiment, the holding member is held between the guide surfaces formed perpendicular to a center axis of the inner tool while being allowed to move in the radial direction. According to the exemplary embodiment, therefore, the can body fitted onto the inner tool may be displaced on the inner tool only in the radial direction perpendicular to the center axis of the can body.

Further, according to the exemplary embodiment, the tip of the neck portion is pushed entirely or at a plurality of portions in the direction parallel to the center axis of the can body. According to the exemplary embodiment, therefore, the can body can be held certainly without inclining on the inner tool so that the surface profile is formed accurately on the neck portion.

BRIEF DESCRIPTION OF THE DRAWINGS

Features, aspects, and advantages of exemplary embodiments of the present invention will become better understood with reference to the following description and accompanying drawings, which should not limit the invention in any way.

DETAILED DESCRIPTION OF THE PREFERRED EMBODIMENT(S)

Figure 1:
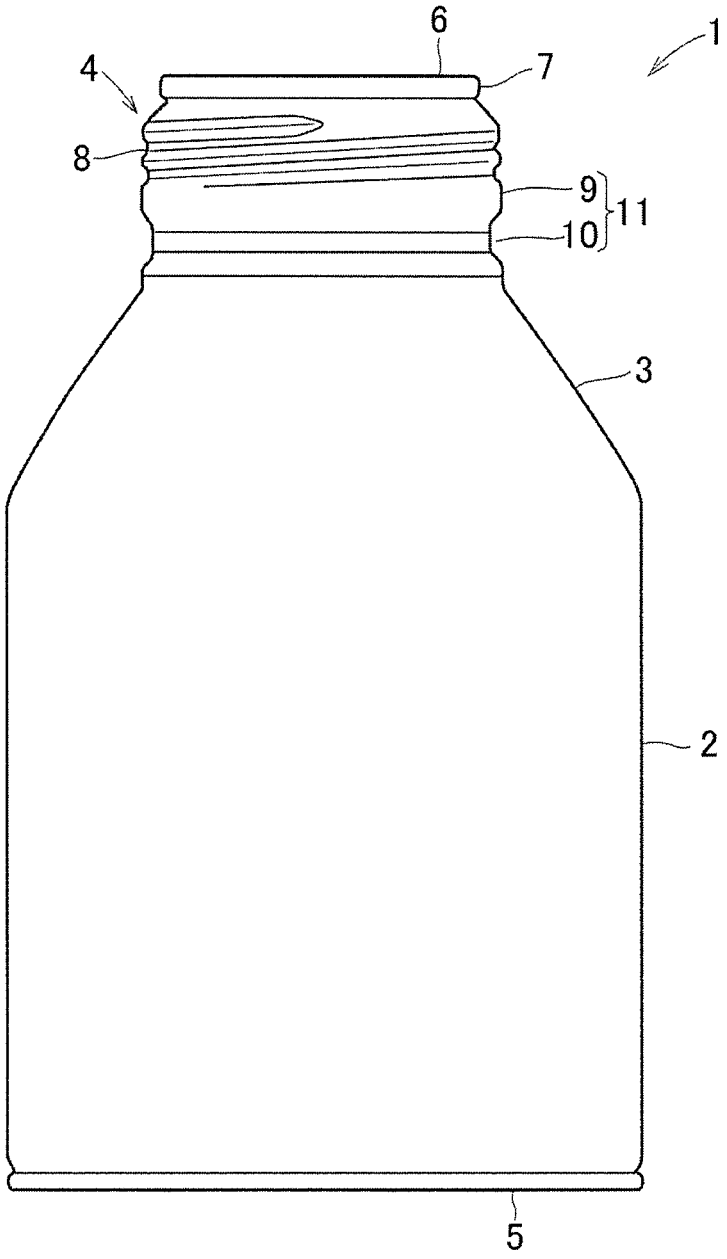
FIG. 1 is a front view of the bottle-shaped can to which the present disclosure is applied.

Hereinafter, an exemplary embodiment of the present disclosure will be explained in more detail with reference to the accompanying drawings. Turning now to FIG. 1, there is shown a bottle-shaped can 1 formed by the forming apparatus and the forming method according to the exemplary embodiment of the present disclosure using a metallic sheet such as an aluminum sheet or a resin-coated aluminum sheet. The bottle-shaped can 1 comprises a diametrically-larger cylindrical trunk portion 2, a shoulder portion 3 formed continuously from the trunk portion 2 whose diameter is reduced gradually, and a diametrically smaller cylindrical neck portion 4 formed continuously from the shoulder portion 3. The neck portion 4 has an opening 6 on its end portion, and the opening 6 opens around a center axis of the bottle-shaped can. A bottom lid 5 is seamed to a bottom of the bottle-shaped can 1. In order to use the opening 6 of the neck portion 4 as a container mouth, a curled portion 7 having a round or an oval cross-section is formed on the opening 6 by folding or rolling an opening edge of the neck portion 4 outwardly into two or three layers. The opening 6 is closed by a resealable closure (not shown) mounted on the neck portion 4.

Specifically, a thread 8 as a thread ridge is formed on the neck portion 4, and the closure is mounted on the neck portion 4 through the thread 8. Although not especially illustrated in FIG. 1, horizontal slits and bridges are formed alternately in a circumferential direction on a lower portion of a skirt of the closure so that a pilfer-proof band is formed on a lower end of the skirt of the closure. An emboss bead 9 is formed below the thread 8, and an annular groove 10 is formed below the emboss bead 9. In the following explanation, the emboss bead 9 and the annular groove 10 will also be called the stepped portion 11. When the closure mounted on the neck portion 4 is turned, the bridges are ruptured and the pilfer-proof band is detached from the lower end portion of the skirt of the closure. The pilfer-proof band thus detached from the skirt of the closure is retained in the annular groove 10.

In the embodiment of the present disclosure, the thread 8, the emboss bead 9, and the annular groove 10 will be called the "surface profile" as a wavy pattern. The forming apparatus according to the embodiment of the present disclosure is adapted to form such surface profile on the neck portion of an interim can body 12 in which the trunk portion 2, the shoulder portion 3, and the neck portion 4 have been formed and a leading end of the neck portion 4 has been trimmed to open, but the bottom lid 5 has not yet been attached to the bottom opening.

Figure 2:
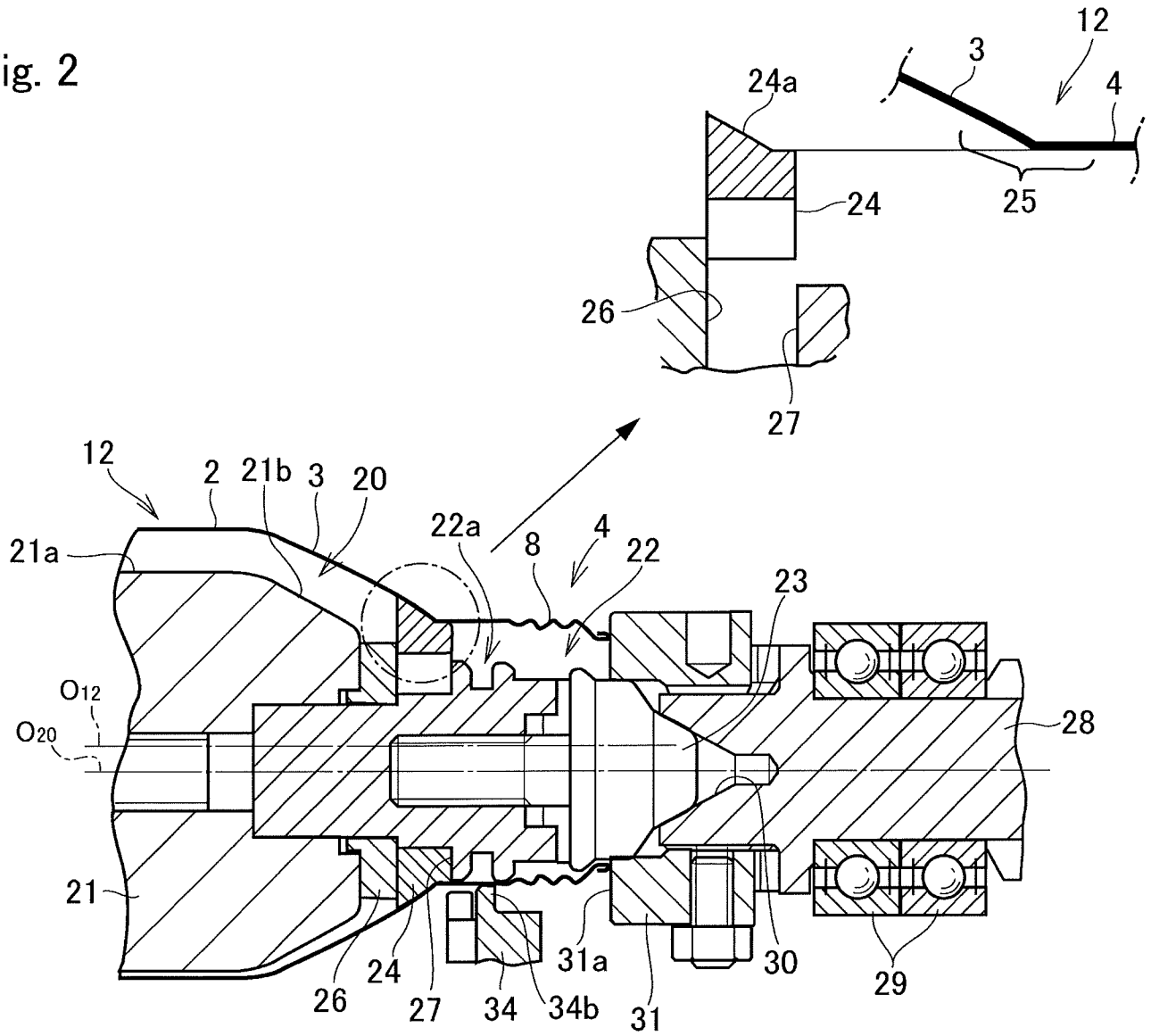
FIG. 2 is a cross-sectional view showing a cross-section of a part of the forming apparatus where an inner tool and a support shaft are arranged.

To this end, the forming apparatus is provided with an inner tool that is inserted loosely into the can body in a rotatable and revolvable manner, and an outer tool that is disposed on outside of the neck portion 4 along a revolution orbit of the inner tool. A structure of the inner tool 20 for forming the stepped portion 11 including the emboss bead 9 is shown in FIG. 2 in more detail. The inner tool 20 shown in FIG. 2 comprises a base section 21 inserted inside of the trunk portion 2 and the shoulder portion 3, and a forming section 22 inserted inside of the neck portion 4. A contour of the base section 21 is substantially congruent with an internal contour of the trunk portion 2 and the shoulder portion 3, and a dimension of the base section 21 is smaller than those of the trunk portion 2 and the shoulder portion 3. Specifically, in the base section 21, an outer diameter of a column section 21*a* is smaller than an inner diameter of the trunk portion 2, and the outer diameter of the base section 21 is reduced gradually within a tapered section 21*b* from the column section 21*a* toward the forming section 22. A maximum outer diameter of the column-shaped forming section 22 is smaller than an inner diameter of the neck portion 4, and the forming section 22 is joined to a leading end (i.e., the right end in FIG. 2) of the base section 21. In the forming section 22, a first forming section 22*a* is formed at a portion corresponding to the stepped portion 11 of the can body 12 fitted onto the inner tool 20 with correct posture. Specifically, the first forming section 22*a* comprises a flange portion for forming the emboss bead 9, and an annular groove for forming the annular groove 10.

A tapered end 23 that is tapered around a center axis O20 of the inner tool 20 is formed on a leading end of the forming section 22 (or the inner tool 20).

In order to prevent the can body 12 fitted loosely onto the inner tool 20 from inclining with respect to the inner tool 20, a holding member 24 is arranged between the first forming section 22*a* and the leading end of the base section 21 in such a manner as to be contacted to an inner circumferential face of the can body 12. In order to maintain a correct posture of the can body 12 concentrically with the inner tool 20, according to the exemplary embodiment, the holding member 24 is shaped into a ring shape. Instead, the holding member 24 may also be formed by connecting a plurality of segments arranged in a circular manner at regular intervals. A contact surface 24*a* is formed on an outer circumferential face of the holding member 24, and a contour of the contact surface 24*a* is congruent with the internal contour of the can body 12 to be contacted to the contact surface 24*a*. Specifically, the contact surface 24*a* is brought into contact to a boundary portion 25 of the can body 12 between the shoulder portion 3 and the neck portion 4. That is, the contact surface 24*a* comprises a tapered section to be contacted to the inner surface of the shoulder portion 3, and a cylindrical portion to be contacted to the inner surface of the neck portion 4. More specifically, as illustrated in FIG. 2 in an enlarged scale, the boundary portion 25 is a depressed portion or an inwardly protruding portion of the can body 12 formed between the shoulder portion 3 and the neck portion 4, and the contour of the contact surface 24*a* is congruent with the contour of the depressed inner surface of the boundary portion 25. That is, the contact surface 24*a* is adapted to receive not only a load (or an external force) applied to the can body 12 in a radial direction but also a load (or an external force) applied to the can body 12 in an axial direction.

The holding member 24 is attached to the inner tool 20 while being allowed to move only in the radial direction of the inner tool 20. In other words, the holding member 24 attached to the inner tool 20 is not allowed to move and tilt in the axial direction. Specifically, an annular pedestal 26 is arranged on the leading end of the base section 21. A shaft portion of the forming section 22 penetrates through the annular pedestal 26, and a diameter of the shaft portion of the forming section 22 is sufficiently smaller than an inner diameter of the holding member 24. The annular pedestal 26 is arranged perpendicular to the center axis O20 of the inner tool 20, and a receiving face 27 is formed on the forming section 22 of the inner tool 20 in parallel with the annular pedestal 26. Specifically, a second flange portion is formed on the first forming section 22*a* to be opposed to the aforementioned flange portion for forming the emboss bead 9, and one of surfaces of the second flange portion opposed to the holding member 24 serves as the receiving face 27. That is, the annular groove for forming the annular groove 10 is formed between the aforementioned flange portion and the second flange portion, and the surface of the second flange portion opposite to the annular groove serves as the receiving face 27. As the annular pedestal 26, the receiving face 27 is also perpendicular to the center axis O20 of the inner tool 20. A clearance between the annular pedestal 26 and the receiving face 27 is substantially identical to a thickness of the holding member 24 in the axial direction. The holding member 24 is held in the clearance between the annular pedestal 26 and the receiving face 27 as a holding section in a slidable manner. That is, the holding member 24 is allowed to move only in the radial direction of the inner tool 20. Accordingly, in the exemplary embodiment, the annular pedestal 26 and the receiving face 27 serve as guide surfaces, and the holding member 24 serves as a movable member.

Instead, the holding member 24 may also be arranged in the base section 21 or the forming section 22. In addition, in order to guide the holding member 24 in the radial direction of the inner tool 20, an annular groove may also be formed on the holding member 24, and a radially protruding flange to be engaged with the annular groove of the holding member 24 may also be formed on the inner tool 20.

The forming apparatus further comprises a support shaft 28 arranged in a leading end side of the inner tool 20 (i.e., in the right side in FIG. 2). The support shaft 28 is adapted to push the can body 12 relatively toward the inner tool 20 thereby fitting the can body onto the inner tool 20. A leading end of the inner tool 20 is brought into abutment to the support shaft 28 so that the inner tool 20 is prevented from being buckled or tilted. For these purposes, the support shaft 28 is situated coaxially with the inner tool 20 while being allowed to move relative to/from the inner tool 20 in the axial direction. Such relative movement between the inner tool 20 and the support shaft 28 may be caused by moving not only the inner tool 20 but also the support shaft 28 in the axial direction. The support shaft 28 is supported by a bearing 29 so that the support shaft 28 is allowed to rotate together with the inner tool 20. A tapered hole 30 is formed on a base end (i.e., an end portion of the inner tool 20 side) of the support shaft 28, and a tapered end 23 of the inner tool 20 is inserted into the tapered hole 30 of the support shaft 28. Specifically, the tapered hole 30 is formed on the base end of the support shaft 28 around a center axis of the support shaft 28. Therefore, the inner tool 20 is joined coaxially with the support shaft 28 by fitting the tapered end 23 of the inner tool 20 into the tapered hole 30 of the support shaft 28.

In order to fix an axial position of the can body 12, a chuck member 31 is attached to the support shaft 28 around the base end portion (i.e., the end portion of the inner tool 20 side). The chuck member 31 is a ring member in which an inner diameter is adapted to fit the chuck member 31 onto the forming section 22 of the inner tool 20, and an outer diameter is adapted to prevent a detachment of the curled portion 7 of the can body 12 even when an eccentricity between the can body 12 and the inner tool 20 becomes maximum. A surface of the chuck member 31 perpendicular to the center axis and opposed to the can body 12 serves as a contact surface 31*a*. A tip of the curled portion 7 of the can body 12 is brought into contact to the contact surface 31*a* thereby fixing an axial position of the can body 12 and preventing inclination of the can body 12 with respect to the inner tool 20.

Figure 3:
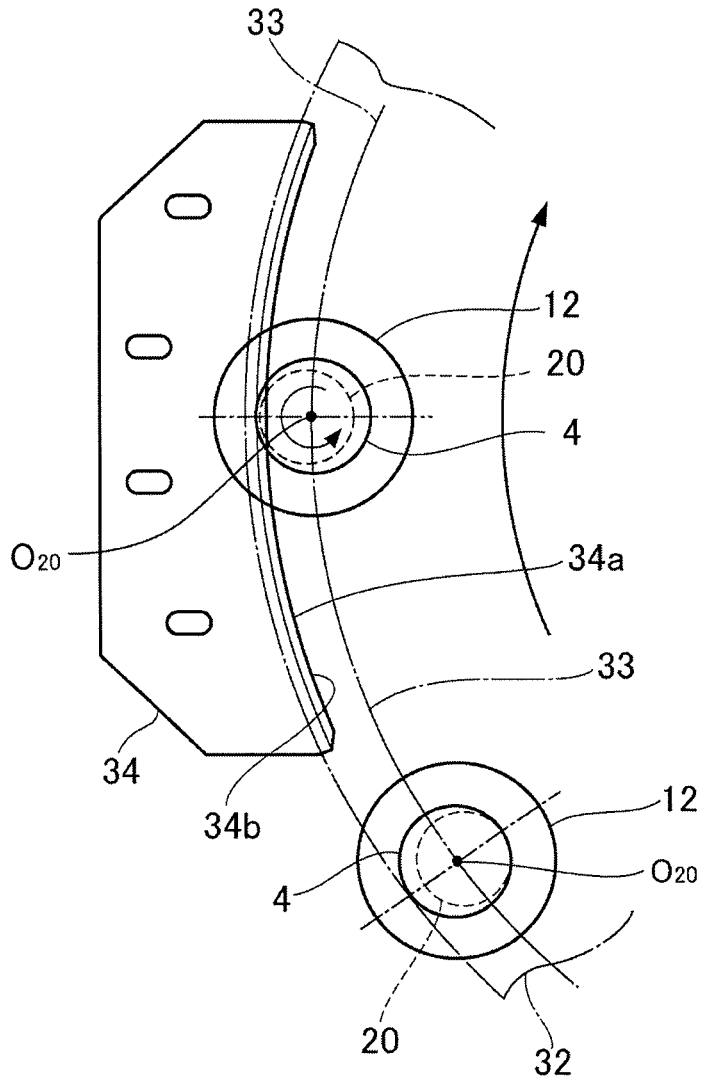
FIG. 3 is a partial front view of the forming apparatus showing a position of an outer tool in an enlarged scale.

As shown in FIG. 3, a plurality of the inner tools 20 are arranged on a periphery of a rotary table 32 at regular intervals. In the rotary table 32, each of the inner tools 20 is allowed to rotate around the center axis O20, and the inner tools 20 are revolved along a predetermined orbit 33 by rotating the rotary table 32. The rotary table 32 may be adapted to rotate not only around a vertical axis but also around a horizontal axis. In the example shown in FIG. 3, the rotary table 32 is adapted to rotate around the horizontal axis. Accordingly, the inner tools 20 are situated laterally to rotate around the horizontal axis, and the support shafts 28 are individually situated laterally to rotate around the horizontal axis in front of the leading end of each of the inner tools 20. The support shafts 28 are attached to a predetermined rotary member such as a rotary disc or a rotary arm rotated coaxially with the rotary table 32 in such a manner as to rotate synchronously with the inner tools 20.

Figure 4:
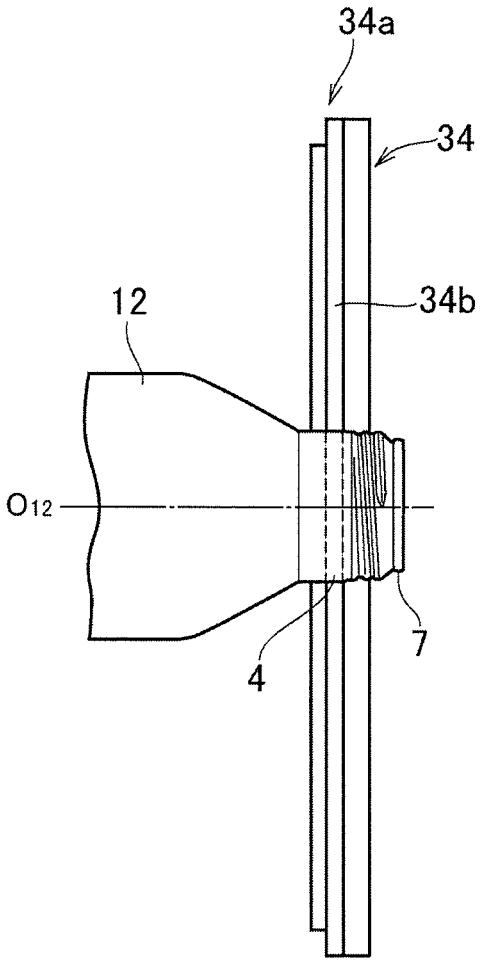
FIG. 4 is a side view of the outer tool.

An outer tool 34 is situated radially outer side of the orbit 33 at a predetermined point. The outer tool 34 comprises an arcuate second forming section 34*a* formed around a curvature center of the orbit 33 of the first forming section 22*a* of the inner tool 20, and the outer tool 34 is fixed in such a manner that the second forming section 34*a* is opposed to the orbit 33. In order to form the stepped portion 11 including the emboss bead 9 and the annular groove 10 on the neck portion 4, as shown in FIGS. 2 and 4, the second forming section 34*a* comprises a ridge 34*b* for pushing the neck portion 4 of the can body 12 partially into the aforementioned annular groove of the first forming section 22*a*.

Figure 5A:
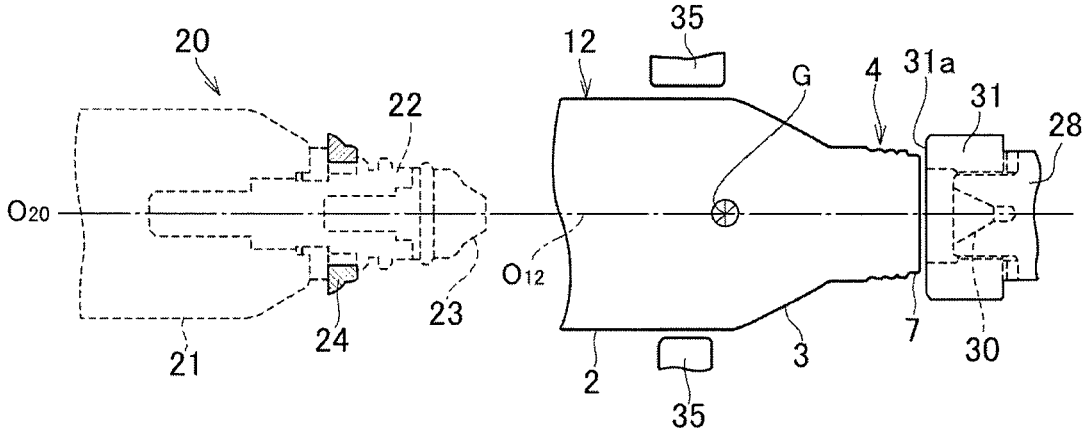
FIGS. 5A, 5B and 5C are cross-sectional views showing steps for forming a stepped portion on a neck portion of a can body.

Here will be explained a method for forming the surface profile including the stepped portion 11 using the forming apparatus according to the exemplary embodiment with reference to FIGS. 5A, 5B and 5C. As illustrated in FIG. 5A, at a position where the can body 12 is fed to the rotary table 32 on the orbit 33 from a feeder (not shown), the inner tool 20 is withdrawn far away from the support shaft 28, and the can body 12 is fed between the support shaft 28 and the inner tool 20 in such a manner that the center axes of the inner tool 20, the can body 12, and the support shaft 28 are aligned to one another. In this situation, therefore, a gravity center G of the can body 12 is substantially situated on the common center axis of the inner tool 20 and the support shaft 28. Specifically, the bottom of the can body 12 has not yet been closed by the bottom lid 5, and the can body 12 is fed between the support shaft 28 and the inner tool 20 while being guided by a guide member 35 in an orientation in which the bottom of the can body 12 opens toward the inner tool 20.

The inner tool 20 and the support shaft 28 are revolved by rotating the rotary table 32. In this situation, for example, the support shaft 28 is moved toward the inner tool 20 to push the can body 12 so that the can body 12 is fitted onto the inner tool 20. In other words, the inner tool 20 is inserted into the can body 12 from the bottom of the can body 12. As described, the base section 21 of the inner tool 20 is thinner than the trunk portion 2 of the can body 12, and the forming section 22 is thinner than the neck portion 4 of the can body 12. In this situation, therefore, the inner tool 20 is fitted loosely into the can body 12 without contacting tightly to the inner surface of the can body 12. As also described, the contour of the contact surface 24*a* of the holding member 24 is congruent with the internal contour of the boundary portion 25 of the can body 12 between the shoulder portion 3 and the neck portion 4. In this situation, therefore, the contact surface 24*a* of the holding member 24 is tightly brought into contact to the inner surface of the boundary portion 25 of the can body 12, and the tip of the curled portion 7 of the can body 12 is brought into abutment to the contact surface 31*a* of the chuck member 31.

Figure 5B:
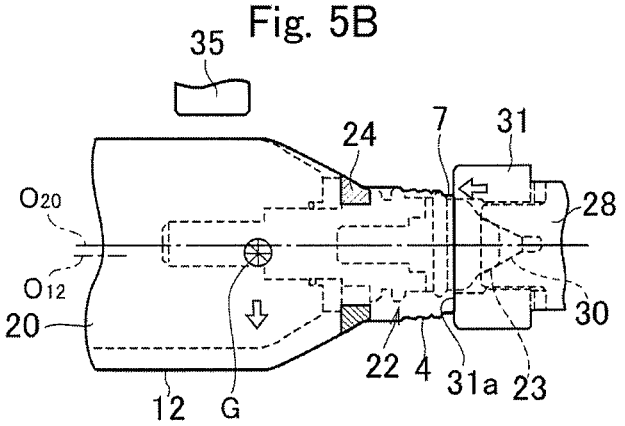
Figure 5C:
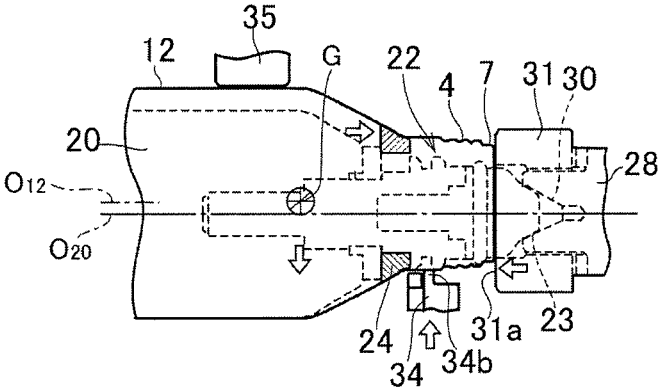

During revolution of the inner tool 20, the can body fitted loosely onto the inner tool 20 is subjected to centrifugal force and gravity, and hence the can body 12 is displaced toward radially outer side of the orbit 33 on the inner tool 20 as illustrated in FIG. 5B. As described, the holding member 24 is attached to the inner tool 20 while being allowed to slide only in the radial direction of the inner tool 20. In this situation, therefore, the holding member 24 is moved radially outwardly together with the can body 12 while being contacted to the boundary portion 25. In other words, the holding member 24 is moved in the radial direction together with the can body 12 in such a manner that the center axes of the holding member 24 and the can body 12 are aligned to each other. The contact surface 24*a* formed on the outer circumferential face of the holding member 24 has a certain length (or width) in the axial direction. In addition, the contact surface 24*a* of the holding member 24 is contacted closely to the inner tapered surface of the shoulder portion 3 and the inner cylindrical surface of the neck portion 4, and the holding member is allowed to move only in the radial direction. In this situation, therefore, the can body 12 can be moved radially in parallel to the inner tool 20 while being supported by the holding member 24, without inclining with respect to the inner tool 20.

In addition, the contact surface 31*a* of the chuck member 31 is formed perpendicular to the center axis, and the tip of the curled portion 7 is entirely brought into contact to the contact surface 31*a*. For this reason, the curled portion 7 of the can body 12 can be pushed homogeneously in parallel with the inner tool 20 by the chuck member 31. In this situation, therefore, the can body 12 can be displaced in the radial direction without inclining with respect to the inner tool 20.

When the inner tool 20 being revolved reaches the position at which the outer tool 34 is situated, the neck portion 4 of the can body 12 is wedged between the inner tool 20 and the outer tool 34. Specifically, as illustrated in FIG. 5C, the neck portion 4 is pushed onto the second forming section 34*a* of the outer tool 34, and consequently the can body 12 is pushed back radially inwardly toward the inner tool 20. In this situation, posture of the can body 12 is also maintained by the holding member 24 and the contact surface 31*a* of the chuck member 31. Therefore, the can body 12 is displaced only in the radial direction perpendicular with the center axis O20 of the inner tool 20, without inclining with respect to the inner tool 20.

In the neck portion 4, portions of similar configurations as the boundary portion 25 exist from the thread 8 to the curled portion 7. However an area of a curved surface from the thread 8 to the curled portion is rather small. Therefore, it is difficult to establish a resistance sufficiently to hold the can body 12 without inclining. Especially, in a case that the curled portion 7 is formed by thinly folding the opening end of the neck portion 4 in a plurality of layers, a contact area of the neck portion 4 to the forming section 22 would be rather small, and configurations of the curled portion 7 would be rather simple. In this case, it is more difficult to hold the can body 12 without inclining. According to the exemplary embodiment of the present disclosure, however, the can body 12 can be held certainly by the holding member 24 without inclining.

Thus, according to the forming method using the forming apparatus according to the exemplary embodiment, the can body 12 fitted loosely onto the inner tool 20 is revolved and rotated together with the inner tool 20. When the can body 12 reaches the position to process the neck portion 4, the can body 12 is subjected to a load from radially outside. In this situation, however, the can body 12 is moved in the radial direction while maintaining its posture parallel to the center axis O20 of the inner tool 20. According to the exemplary embodiment of the present disclosure, therefore, the stepped portion 11 can be formed on the neck portion 4 of the can body 12 by the inner tool 20 and the outer tool 34 without inclining the neck portion 4 of the can body 12. For this reason, the stepped portion 11 can be formed accurately on the neck portion 4 of the can body 12.

Although the above exemplary embodiments of the present disclosure have been described, it will be understood by those skilled in the art that the present disclosure should not be limited to the described exemplary embodiments, and various changes and modifications can be made within the scope of the present disclosure. For example, the forming apparatus and the forming method according to the exemplary embodiment may also be used to form the thread 8 on the neck portion 4. In addition, instead of pushing the tip of the curled portion entirely, the tip of the curled portion may also be pushed at plurality of points. In this case, the can body may also be prevented from being inclined.

What is claimed is:

1. A forming apparatus for forming a surface profile on a neck portion of a can body of a bottle-shaped can, wherein the can body comprises a trunk portion in which a bottom is opened, a shoulder portion which is formed continuously from the trunk portion on a side opposite to the bottom, and in which a diameter is reduced, and a neck portion which is formed continuously from the shoulder portion on the opposite side of the trunk portion, in which the diameter is further reduced, and which is opened around a center axis of the can body, the forming apparatus comprising:

an inner tool which is allowed to rotate and revolve, and to which the can body is fitted thereon while being allowed to move in a radial direction; and an outer tool that is situated along a revolution orbit of the inner tool, wherein the forming apparatus is configured to form the surface profile on the neck portion in a circumferential direction by sandwiching the neck portion between the outer tool and the inner tool revolving along the outer tool, the inner tool comprises a first forming section having a diameter smaller than an inner diameter of the neck portion, that is inserted into the neck portion from the bottom of the can body to form the surface profile, the outer tool comprises a second forming section that is opposed to the inner tool to form the surface profile on the neck portion by sandwiching the neck portion by the first forming section and the second forming section, the inner tool further comprises a holding member that is situated coaxially with the can body to contact an inner surface of the can body, and the holding member is attached to the inner tool while being allowed to move in the radial direction together with the can body.

2. The forming apparatus as claimed in claim 1, wherein the can body comprises a boundary portion between the shoulder portion and the neck portion, the boundary portion includes a depressed portion in which a cross-section of the neck portion in an axial direction of the can body protrudes inwardly, and the holding member comprises a contact surface that is brought into contact with the boundary portion from inside of the can body.

3. The forming apparatus as claimed in claim 2, wherein the holding member is shaped into a ring shape, the inner tool further comprises a holding section in which the holding member is held while being allowed to move in the radial direction, and the holding section comprises guide surfaces formed perpendicular to a center axis of the inner tool respectively and parallel to each other to sandwich the holding member from both sides of the holding member in an axial direction of the inner tool.

4. The forming apparatus as claimed in claim 3, further comprising:

a chuck member that pushes the can body in the axial direction of the can body, wherein the chuck member comprises a contact surface that is formed perpendicular to the center axis of the can body to contact a tip of the neck portion.

5. The forming apparatus as claimed in claim 2, further comprising:

a chuck member that pushes the can body in the axial direction of the can body, wherein the chuck member comprises a contact surface that is formed perpendicular to the center axis of the can body to contact a tip of the neck portion.

6. The forming apparatus as claimed in claim 1, wherein the holding member is shaped into a ring shape, the inner tool further comprises a holding section in which the holding member is held while being allowed to move in the radial direction, and the holding section comprises guide surfaces formed perpendicular to a center axis of the inner tool respectively and parallel to each other to sandwich the holding member from both sides of the holding member in an axial direction of the inner tool.

7. The forming apparatus as claimed in claim 6, further comprising:

a chuck member that pushes the can body in an axial direction of the can body, wherein the chuck member comprises a contact surface that is foil led perpendicular to the center axis of the can body to contact a tip of the neck portion.

8. The forming apparatus as claimed in claim 1, further comprising:

a chuck member that pushes the can body in an axial direction of the can body, wherein the chuck member comprises a contact surface that is formed perpendicular to the center axis of the can body to contact a tip of the neck portion.

* * * * *